US005549162A

United States Patent [19]

Moody et al.

[11] Patent Number: 5,549,162

[45] Date of Patent: Aug. 27, 1996

[54] ELECTRIC WIRELINE FORMATION TESTING TOOL HAVING TEMPERATURE STABILIZED SAMPLE TANK

[75] Inventors: Michael J. Moody, Katy; Michael Yesudas; John M. Michaels, both of Houston, all of Tex.

[73] Assignee: Western Atlas International, Inc., Houston, Tex.

[21] Appl. No.: 498,540

[22] Filed: Jul. 5, 1995

[51] Int. Cl.[6] ..... E21B 49/10

[52] U.S. Cl. ..... 166/264; 73/863.11; 73/864.91; 166/100; 166/162

[58] Field of Search ..... 166/264, 100, 166/162; 73/863.11, 864.91, 864.51, 155

[56] References Cited

U.S. PATENT DOCUMENTS

| | | | |
|---|---|---|---|
| 3,022,826 | 2/1962 | Kisling, III | 166/100 |
| 4,296,637 | 10/1981 | Calamur et al. | 73/864.91 X |
| 4,507,957 | 4/1985 | Montgomery et al. | 166/100 X |
| 4,756,200 | 7/1988 | Ramsner et al. | 73/863.11 |
| 4,950,844 | 8/1990 | Hallmark et al. | 175/59 |
| 5,303,775 | 4/1994 | Michaels et al. | 166/264 |

FOREIGN PATENT DOCUMENTS

| | | | |
|---|---|---|---|
| 2257181 | 1/1993 | United Kingdom | 166/264 |
| 9109207 | 6/1991 | WIPO | 166/264 |

*Primary Examiner*—Hoang C. Dang
*Attorney, Agent, or Firm*—Richard A. Fagin

[57] ABSTRACT

The present invention is a sample tank for storing and transporting a fluid sample withdrawn from an earth formation by a formation fluid sampling tool. The sample tank includes a storage cylinder adapted to withstand high internal pressure. The storage cylinder is selectively hydraulically connected to the sampling tool for conducting the fluid sample into the storage cylinder. A fusible metal substantially surrounds the storage cylinder. The fusible metal has a melting temperature not more than the temperature of the fluid sample, so that solidification of the fusible metal maintains the fluid sample substantially at the melting temperature of the fusible metal during solidification of the fusible metal as the tool is withdrawn from the wellbore and cooled. The fusible metal is surrounded by an outer housing which contains the fusible metal when it is in a liquid state.

10 Claims, 2 Drawing Sheets

ELECTRIC WIRELINE FORMATION TESTING TOOL HAVING TEMPERATURE STABILIZED SAMPLE TANK

BACKGROUND OF THE INVENTION

1. Field of the Invention

The present invention is related to the field of electric wireline formation testing tools. More specifically, the present invention is related to systems for recovering samples of fluid from earth formations which are substantially maintained in their original phase composition.

2. Description of the Related Art

Electric wireline formation testers are known in the art for withdrawing samples of fluids from pore spaces of earth formations penetrated by wellbores. The formation testing tools known in the art typically include a sample tank into which the sample of fluid withdrawn from the earth formation can be discharged and then transported back to the earth's surface for laboratory analysis.

Some of the earth formations from which fluid samples are withdrawn can be located at significant depths within the earth. As is understood by those skilled in the art, the temperature and the pressure of the fluids within the pore space of a particular earth formation can be related to the depth of the particular formation within the earth. As is also understood by those skilled in the art, native fluids within the earth formation can include hydrocarbons. The chemical composition of the hydrocarbons within any particular formation fluid is typically unique to the particular formation and is related to the temperature and pressure to which the formation was subjected during the geologic processes which generate and accumulate the hydrocarbon in the particular earth formation.

It is known in the art for hydrocarbons in earth formations to undergo phase changes when pressures and temperatures on the hydrocarbons are reduced. Phase changes can include condensation of gaseous hydrocarbon into liquid and precipitation of solid hydrocarbon which is in solution in liquid hydrocarbon. The pressure and temperature at which a particular phase change occurs depend on the concentration of liquid and gas in solution. Phase changes which can occur while acquiring a fluid sample for laboratory analysis can so alter these concentrations that the laboratory analysis of phase behavior is subject to error.

Phase changes can also reduce the efficiency of production by reducing the effective permeability of the earth formation with respect to the flow of hydrocarbon. For example, liquid resulting from condensation has higher viscosity than gas. For any value of differential pressure and formation permeability, higher viscosity results in lower flow rates.

Production of hydrocarbon from the formation at excessive rates can cause such phase changes particularly because of the drop in temperature associated with high rates of production.

It is useful to the wellbore operator to be able to determine the composition of the hydrocarbons in the formation as closely as possible. It is particularly useful to the wellbore operator to be able to determine temperatures and pressures at which phase changes in a particular hydrocarbon sample may occur. Determining the hydrocarbon composition and the conditions under which phase changes occur can enable the wellbore operator to design production equipment for the wellbore so that the efficiency with which the hydrocarbons are extracted from the formation is optimized, as is understood by those skilled in the art.

It is known in the art to withdraw samples of fluid from the earth formation with a wireline formation testing tool having a so-called variable pressure control ("VPC"). VPC is described for example in U.S. Pat. No. 4,507,957 issued to Michaels et al. The VPC in the Michaels et al '957 patent enables the tool operator to cause the fluid to flow from the formation into a sample tank at a sufficiently slow rate so that the fluid pressure is typically maintained above condensation or precipitation pressures.

U.S. Pat. No. 5,303,775 issued to Michaels et al describes a method for pumping fluid from the formation into the sample tank at pressures above the native fluid pressure in the earth formation so that some compensation for cooling of the fluid sample can be obtained. Cooling results when the testing tool is withdrawn from the wellbore to the earth's surface. Sometimes the cooling can be sufficient to cause a phase change in certain fluid samples. Compensation by overpressurizing the sample can reduce or eliminate temperature induced phase change in the fluid sample.

A drawback to the overpressurizing method for reducing phase change in hydrocarbon fluid samples is that some samples have compositions which will still undergo phase change as a result of cooling despite overpressurizing the sample. Phase change in the sample may preclude the wellbore operator from determining the composition of the hydrocarbon as it exists in its native state in the earth formation, making it difficult to design appropriate production equipment.

Accordingly, there is a need for an electric wireline formation testing tool which can maintain the temperature of a fluid sample in its test tank as near as possible to the native temperature to reduce the possibility of phase change in the fluid sample.

SUMMARY OF THE INVENTION

The present invention is a sample tank for storing and transporting a fluid sample withdrawn from an earth formation by a formation fluid sampling tool. The sample tank includes a storage cylinder adapted to withstand high internal pressure. The storage cylinder is selectively hydraulically connected to the sampling tool for conducting the fluid sample into the enclosed volume. A fusible metal substantially surrounds the storage cylinder. The fusible metal has a melting temperature not more than the temperature of the fluid sample, so that solidification of the fusible metal maintains the fluid sample substantially at the melting temperature of the fusible metal during solidification of the fusible metal as the tool is withdrawn from the wellbore and cooled. The fusible metal surrounded by an outer housing for containing the fusible metal when it is in a liquid state.

DESCRIPTION OF THE PREFERRED EMBODIMENT

Figure 1:
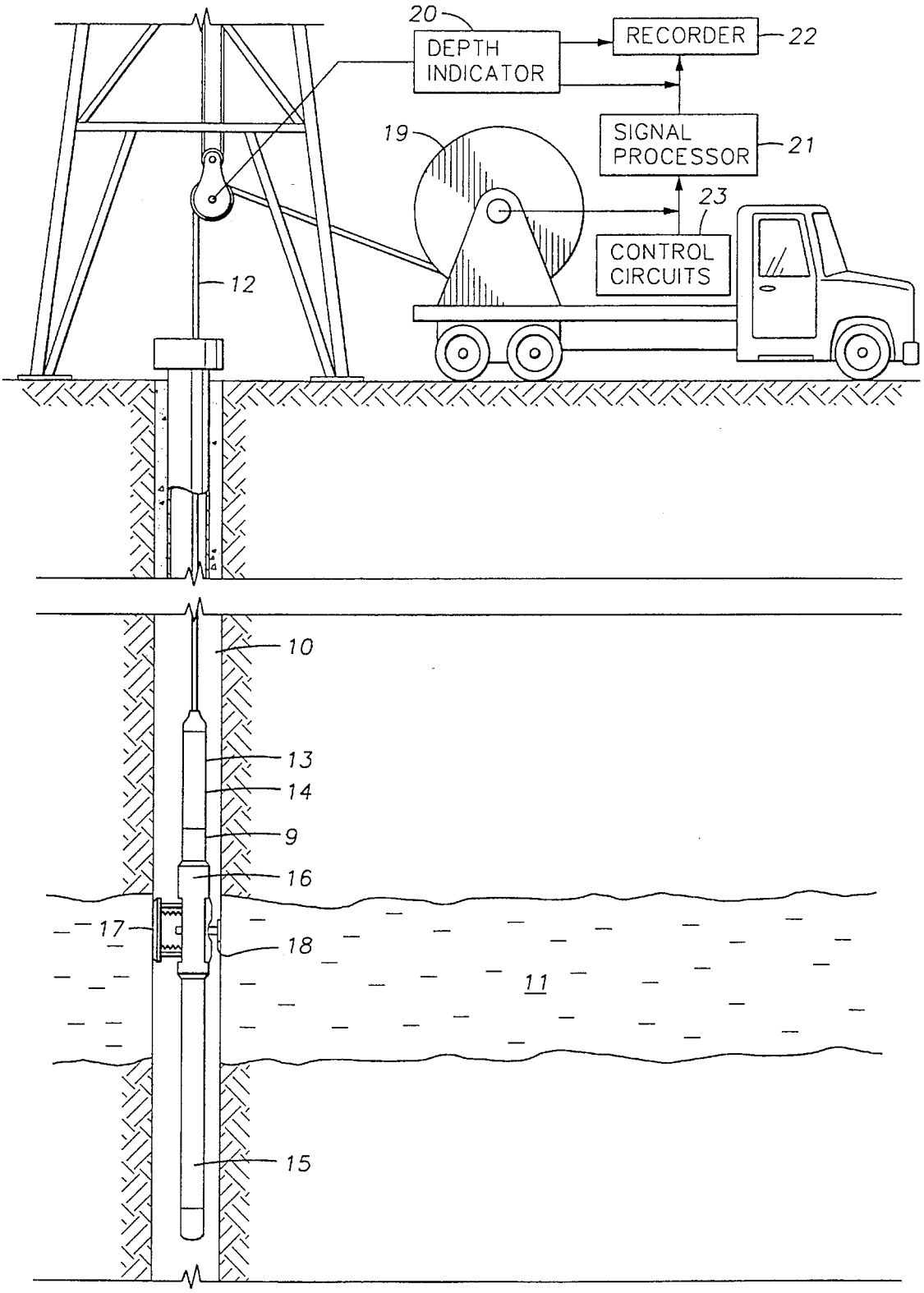
FIG. 1 shows a formation testing tool having a sample tank according to the present invention.

A wireline formation test tool is generally shown at 13 in FIG. 1. The tool 13 is typically attached to one end of an armored electrical cable 12 and is lowered into a wellbore 10 drilled through the earth. The cable 12 is typically extended into the wellbore 10 by means of a winch 19 located at the earth's surface, or a similar apparatus familiar to those skilled in the art.

The tool 13 comprises a housing 16. A back-up shoe and a mechanism for extending the shoe, shown generally at 17, are typically disposed within the housing 16. The housing 16 also includes a tubular probe 18 positioned in the housing 16 opposite the back-up shoe 18. The probe 18 can be selectively extended and put into contact with the wall of the wellbore 10, as will be further explained. A sample tank 15 according to the present invention can be attached to the lower end of the housing 16 and can be selectively hydraulically connected to the probe 18 in order to store samples of fluids withdrawn from the earth. The probe 18, the back-up shoe 17 and selective valves (not shown) disposed within the housing 16 for operating the probe 18 and the shoe 17 receive hydraulic operating power from an hydraulic power unit 9 which can be attached to the upper end of the housing 16.

The various functions of the tool 13, including extension of the shoe 17 and extension of the probe 18, can be controlled by the system operator entering command signals into control circuits 23 which are located at the earth's surface and are electrically connected to the cable 12. The command signals are decoded in an electronics unit 14 disposed within the housing 16. The tool 13 also typically comprises sensors (not shown) for measuring pressure, temperature and displaced fluid volume within hydraulic lines (not shown in FIG. 1) connected to a sample pretest chamber (not shown in FIG. 1). Measurements made by the sensors (not shown) can be transmitted to the earth's surface by the electronics unit 14 in the form of electrical signals. At the earth's surface the signals are decoded by a signal processor 21 which is electrically connected to the cable 12. The decoded signals are reformatted into measurements which can be observed by the system operator and can be recorded by a recorder 22 connected to the signal processor 21. An apparatus having the aforementioned probe 18, back-up shoe 17, housing 16, electronics unit 14, hydraulic power unit 9 and selective valves (not shown) which will withdraw samples from the earth formation is disclosed, for example in U. S. Pat. No. 5,303,775 issued to Michaels et al. The apparatus disclosed in the Michaels et al '775 patent is provided only as an example of apparatus which can selectively withdraw fluids from the pore spaces of an earth formation and discharge the samples into a sample tank. The apparatus disclosed in the Michaels et al '775 patent should not be construed as a limitation on the present invention, as other devices known in the art can also selectively withdraw fluid samples from earth formations and discharge the samples into a sample tank.

When the system operator enters of the appropriate command signals into the control circuits 23, the tool 13 starts to withdraw fluid from the formation 11 through the probe 18 and discharge the fluid into the sample tank 15. The temperature of the fluid as it is withdrawn will typically be substantially the same as the temperature in the formation 11. If the tool 13 is withdrawn from the wellbore 10, the temperature of the fluid in the sample tank 15 will gradually decrease until it reaches the ambient temperature at the earth's surface. As will be further explained, the sample tank of the present invention provides means for maintaining the temperature within the sample tank at an elevated level which is close to the temperature of the formation 11.

Figure 2:
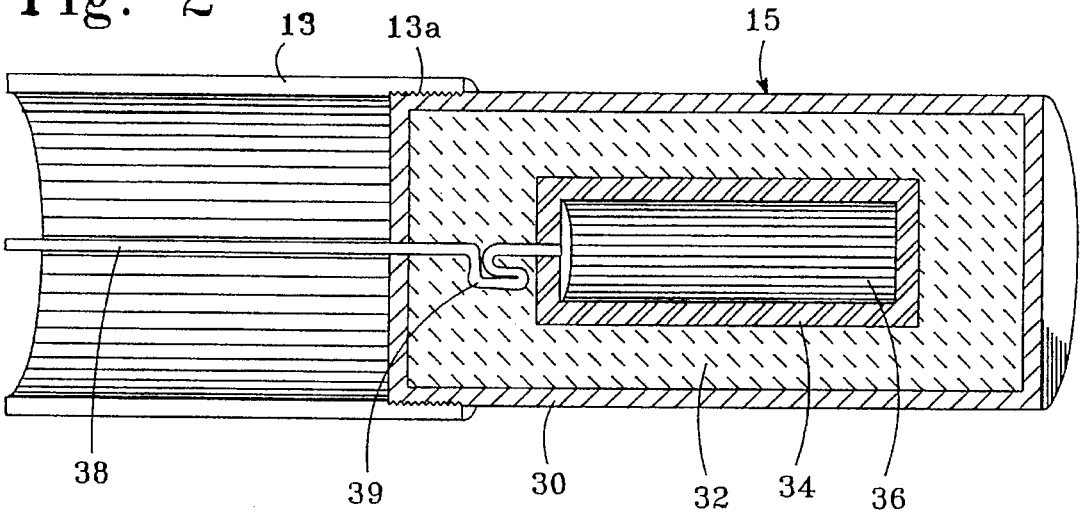
FIG. 2 shows a cross-section of the sample tank of the present invention.

The sample tank 15 of the present invention, including means for maintaining the temperature of the fluid sample in the tank 15, can be better understood by referring to FIG. 2. The sample tank 15 of the present invention includes a storage cylinder 34. The storage cylinder is typically constructed from a high-strength, corrosion-resistant metal alloy such as stainless steel, and typically is designed to withstand internal pressures of at least 15,000 psi. The storage cylinder 34 defines an enclosed volume 36 into which the fluid sample is actually discharged. The storage cylinder 34 can be hydraulically connected to the selective valves (not shown) in the tool (13 in FIG. 1) which selectively direct discharge of the fluid sample through a sample line 38 into the volume 36. The sample line 38 can include a P-trap 39 or similar device for reducing convective heat transfer out of the fluid in the enclosed volume 36.

In a novel aspect of the present invention, the storage cylinder 34 is substantially surrounded by a low-temperature fusible metal 32 such as certain bismuth-containing alloys made by Cerro Metal Products and sold under the trade name Cerro Alloys. The purpose of the low-temperature fusible metal 32 will be further explained. The fusible metal 32 can be enclosed in an outer housing 30, which in the present embodiment can be composed of stainless steel or similar alloy. The outer housing 30 can be threadedly connected to one end of the tool 13 by a threaded coupling, as shown generally at 13A.

The purpose of the fusible metal 32 is to thermally insulate the storage cylinder 34 to reduce heat loss as the tool 13 is withdrawn from the wellbore (10 in FIG. 1) and is therefore exposed to lower temperatures. The fusible metal 32 is familiar to those skilled in the art as more typically used in well logging tools having scintillation detector radiation counters. In the radiation detector tools known in the art, fusible metal forms a cover for a Dewar flask or similar insulating container. The fusible metal in the cap of a Dewar flask typically is intended to prevent the temperature in the Dewar flask from exceeding the melting point of the metal, by absorbing the heat transferring through the cover by melting the metal. The temperature in the Dewar flask remains substantially at the melting point of the metal while melting is in progress, thereby providing a time period in which the scintillation counter can be inserted into a wellbore having a temperature exceeding the temperature rating of the scintillation counter.

In the present invention, the tool 13 is typically lowered into the wellbore 10 to a depth at which the temperature exceeds the melting point of the fusible metal 32, whereupon the metal 32 melts. After withdrawal of a fluid sample from the formation 11, as the tool 13 is withdrawn from the wellbore 10 and is cooled, solidification of the fusible metal 32 occurs. As the fusible metal 32 solidifies, the latent heat of fusion of the metal 32 can be transferred to the wellbore (10 in FIG. 1), and as is understood by those skilled in the art, the temperature of the metal 32 will remain substantially constant during solidification. The temperature of the enclosed volume 36 is therefore substantially maintained at the melting temperature of the fusible metal 32 as long as some of the fusible metal 32 remains in the liquid state.

Figure 3:
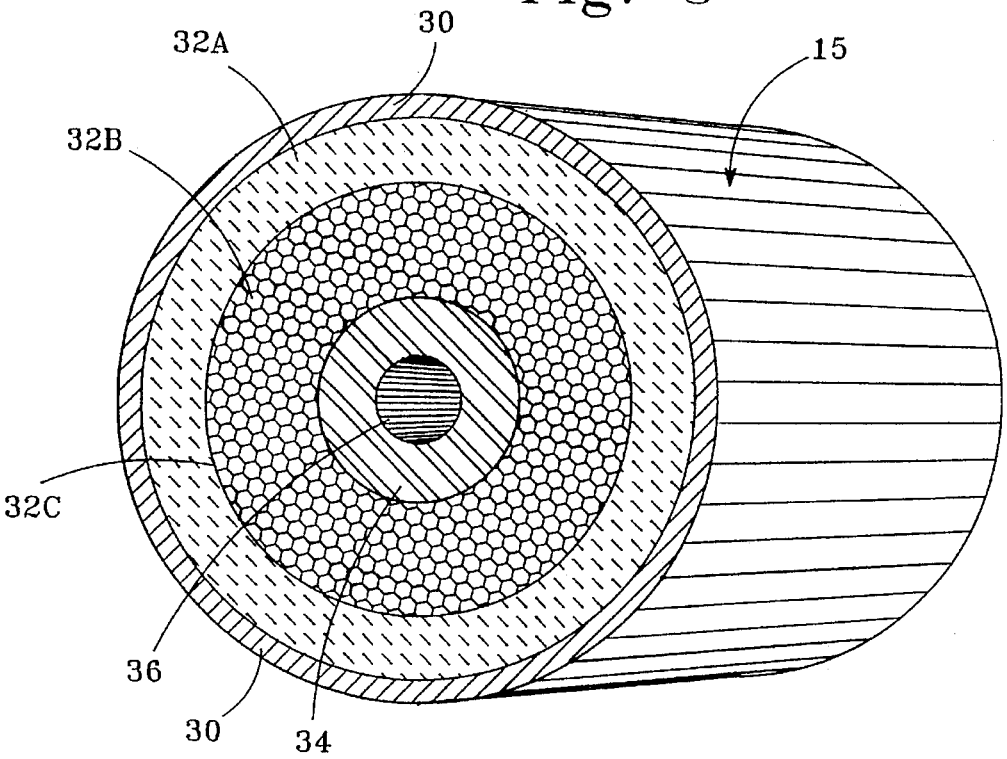
FIG. 3 shows a plan-view of the sample tank of the-present invention during solidification of a fusible metal.

FIG. 3 shows a cross-section of the sample tank 15 in which some of the fusible metal (32 in FIG. 2) has begun to solidify, to further explain the operation of the present invention. As the tool (13 in FIG. 1) is withdrawn from the wellbore (10 in FIG. 1) so that the temperature of the wellbore 10 drops below the melting point of the metal 32, the metal 32 begins to solidify at the point of contact with the outer housing 30. As solidification of the metal 32 continues, the boundary (shown at 32C between liquid metal 32B and solid metal 32A moves inwardly towards the storage cylinder 34. As the boundary 32C moves inward and the mass of solid metal increases, the volume of liquid metal 32B decreases correspondingly. The decreasing liquid metal 32B volume reduces convective heat loss, thereby reducing the volumetric solidification rate for the remaining liquid 32B.

As is known to those skilled in the art, the temperature of the fluid sample can depend on, among other things, the depth in the wellbore (10 in FIG. 1) of the formation (11 in FIG. 1) from which the sample is withdrawn. Fluid samples can therfore have vastly different temperatures from each other. The melting temperature of the fusible metal (32 in FIG. 2) must therefore correspond to the temperature of the fluid sample in order for the metal 32 to melt, so that the metal 32 can perform as a heat-retaining insulator by solidification. The chemical composition of the fusible metal 32 can be chosen to provide a melting temperature for the particular fluid sample temperature expected. For example, "Cerro Alloy-Physical Data/Applications", publication no. RQ-793-P, Cerro Metal Products, Bellefonte, Pa. describes chemical compositions for fusible metals which have predetermined melting temperatures in a range from 117 degrees Fahrenheit to 338 degrees Fahrenheit. It is contemplated that a plurality of individual sample tanks (15 in FIG. 2), each including fusible metal (32 in FIG. 2) having a different melting point, can be provided with the tool (13 in FIG. 1) at a particular wellbore (10 in FIG. 1). The system operator can select the individual sample tank 15 including the fusible metal 32 having the melting point closest to but below the earth formation ( 11 in FIG. 1) temperature prior to inserting the tool 13 in the wellbore 10 for obtaining a fluid sample.

The selected sample tank 15 can be pre-heated at the earth's surface to melt the fusible metal 32 before inserting the tool in the wellbore 10 if it is expected that the tool 13 will not be in the wellbore 10, at a depth at which the temperature exceeds the melting temperature of the fusible metal 32, long enough to melt all of the fusible metal 32.

Although the fusible metal 32 could in theory have a predetermined composition which has a melting point exactly matching the formation temperature, because each formation temperature can be different, a different composition of fusible metal 32 might be needed to be provide an individual sample tank 15 for each formation 11. Providing large numbers of different sample tanks 15 having different fusible metal 32 compositions can be impractical. It is contemplated that the fusible metal 32 can be provided in a plurality of compositions to provide sample tanks having enclosed volume (36 in FIG. 2) stable temperatures in increments of about 50 degrees Fahrenheit.

By providing fusible metal 32 for sample tanks 15 in 50 degree melting point increments, some fluid samples could be reduced in temperature by as much as 50 degrees as the tool 13 is withdrawn from the wellbore 10 and the fluid sample cools to the melting point of that selected composition fusible metal 32. In order to provide compensation for this drop in temperature, the fluid sample can be discharged into the tank 15 to a pressure exceeding the native fluid pressure, by a method described in U.S. Pat. No. 5,303,775 issued to Michaels et al and incorporated herein by reference.

The sample tank 15 disclosed herein, by maintaining the temperature of the fluid sample above the ambient temperature of the earth's surface, provides fluid samples from earth formations which have a higher probability of remaining in their original phase concentrations. Fluid samples in their original phase compositions, as is understood by those skilled in the art, can be more useful in evaluating the potential productivity of a petroleum reservoir in an earth formation.

Those skilled in the art will undoubtedly be able to devise different embodiments of the present invention which do not depart from the spirit of the invention disclosed herein. The scope of the invention therefore should be limited only by the claims appended hereto.

What is claimed is:

1. A sample tank for storing and transporting a fluid sample withdrawn from an earth formation by a formation fluid sampling tool, comprising:

a storage cylinder adapted to withstand high internal pressure, said storage cylinder selectively hydraulically connected to said sampling tool so that said fluid sample can be conducted into said storage cylinder;

a fusible metal substantially surrounding said storage cylinder, said fusible metal having a melting temperature not greater than a temperature of said fluid sample so that solidification of said fusible metal maintains said fluid sample substantially at said melting temperature as said fluid sampling tool is cooled below said melting temperature; and an outer housing surrounding said fusible metal to contain said fusible metal when said fusible metal is in a liquid state.

2. The sample tank as defined in claim 1 wherein said fusible metal comprises a bismuth-containing alloy.

3. The sample tank as defined in claim 1 wherein said storage cylinder comprises stainless steel.

4. An apparatus for withdrawing a fluid sample from an earth formation penetrated by a wellbore, comprising:

an elongated housing adapted to traverse said wellbore;

a probe disposed within said housing and adapted to be selectively placed in hydraulic communication with said earth formation, said probe adapted to exclude hydraulic communication with said wellbore when said probe is in communication with said earth formation;

a sample tank attached to said housing and selectively placed in hydraulic communication with said probe, said tank including a storage cylinder adapted to withstand high internal pressure, said storage cylinder selectively hydraulically connected to said sampling tool for conducting said fluid sample into said storage cylinder, said tank including a fusible metal substantially surrounding said storage cylinder, said fusible metal having a melting temperature not greater than a temperature of said fluid sample so that solidification of said fusible metal maintains said fluid sample substantially at said melting temperature during said solidification as said tool is cooled below said melting temperature, said tank including an outer housing surrounding said fusible metal to contain said fusible metal when said fusible metal is in a liquid state.

5. The apparatus as defined in claim 4 wherein said storage cylinder comprises stainless steel.

6. The apparatus as defined in claim 4 wherein said fusible metal comprises a bismuth-containing alloy.

7. A method of withdrawing a sample of fluid from an earth formation penetrated by a wellbore, comprising the steps of:

inserting a formation testing tool into said wellbore to a depth of interest;

extending a probe from said testing tool so as to contact said earth formation;

operating selective hydraulic valves and a fluid pump in said tool to withdraw said sample of fluid from said earth formation;

discharging said fluid sample into a sample tank attached to said tool and selectively placed in hydraulic communication with said probe, said tank including a storage cylinder adapted to hold said fluid sample and withstand high internal pressure, said tank including a fusible metal substantially surrounding said storage cylinder, said fusible metal having a melting temperature not more than a temperature of said fluid sample so that solidification of said fusible metal maintains said fluid sample substantially at said melting temperature during said solidification, said tank including an outer housing surrounding said fusible metal to contain said fusible metal when said fusible metal is in a liquid state;

retracting said probe from said earth formation; and withdrawing said tool from said wellbore before said fusible metal has completely solidified, thereby maintaining temperature of said fluid sample substantially at said melting temperature of said fusible metal.

8. The method as defined in claim 7 further comprising selecting a composition of said fusible metal so that said melting temperature is within a predetermined range of temperatures below an expected temperature of said fluid sample.

9. The method as defined in claim 7 further comprising controlling a pressure drop of said fluid sample in said earth formation during said step of operating said valves to reduce the possibility of phase change in said fluid sample.

10. The method as defined in claim 9 further comprising discharging said fluid sample into said tank to a pressure exceeding a native pressure of said earth formation to reduce the possibility of phase change in said fluid sample.

* * * * *